US006823615B2

(12) United States Patent
Strait

(10) Patent No.: US 6,823,615 B2
(45) Date of Patent: Nov. 30, 2004

(54) SECTIONAL SNOW PLOW

(76) Inventor: Randy W. Strait, 22763 S. Center Rd., Frankfort, IL (US) 60423

( * ) Notice: Subject to any disclaimer, the term of this patent is extended or adjusted under 35 U.S.C. 154(b) by 0 days.

(21) Appl. No.: 10/057,269

(22) Filed: Jan. 28, 2002

(65) Prior Publication Data

US 2003/0140528 A1 Jul. 31, 2003

(51) Int. Cl.[7] ..... E01H 5/04
(52) U.S. Cl. ..... 37/233; 37/266
(58) Field of Search ..... 37/232, 233, 266, 37/268, 241, 231, 407, 446, 460; 172/684.5, 765, 766, 719, 772

(56) References Cited

U.S. PATENT DOCUMENTS 2,962,821 A * 12/1960 Peitl ..... 37/233
4,669,205 A * 6/1987 Smathers ..... 37/232
5,140,763 A * 8/1992 Nichols, IV ..... 37/233
5,471,770 A * 12/1995 Ferreira ..... 37/264
5,819,443 A * 10/1998 Winter ..... 37/233

* cited by examiner

*Primary Examiner*—Robert E. Pezzuto
(74) *Attorney, Agent, or Firm*—Ernest Kettelson

(57) ABSTRACT

A sectional snowplow having a plurality of separate sections, each mounted separately and independently to the snowplow frame for limited movement upwardly and downwardly relative to the sections of the snowplow on either side, whereby one section can rise to scrape over a rise in the surface below that section without causing the sections on either side to also rise above the surface below such other sections. Each section is mounted separately and independently to the snowplow frame by flexible members of a resilient but nevertheless sturdy material such as polyurethane. A preferred material is known in the trade as polyurethane 90 A Shore hardness.

12 Claims, 9 Drawing Sheets

SECTIONAL SNOW PLOW

FIELD OF THE INVENTION

This invention relates to the field of snowplows having a moldboard or contoured scraping wall member to scrape or push snow forward and to one side, and in particular to a wide snowplow of this type having separately mounted sections in side-by-side relationship whereby each section can rise and fall independently of the sections on either side. Thus all sections can remain in scraping contact with the surface on which they are being used, even though some portions of that surface may be elevated relative to adjacent portions.

BACKGROUND OF THE INVENTION

Snowplows having a single unitary moldboard or scraping wall member have been known to the prior art for a long time. One of the biggest problems with snowplows of this type is that a rise in the surface level in contact with one portion of the scraping edge of the unitary moldboard automatically causes the entire unitary moldboard to rise thereby raising the scraping edge of the remainder of the moldboard above the surface beneath such remaining portions, thereby failing to remove the snow from those portions. The present invention solves that problem by providing a wide snowplow of the moldboard type with independently movable sections whereby one section can rise or fall depending on the contour of the surface on which it is being used without causing the sections on either side to rise or fall. Thus, all sections can remain in continuous scraping contact with the surface on which the snowplow is being used even though adjacent portions of that surface may rise and fall relative to each other. Prior art of which the inventor is aware include the disclosures set forth in the following United States Patents, copies of which are readily available to the public and others having a need to know or an interest in the subject matter, in the United States Patent and Trademark Office as well as in public libraries in a number of cities throughout the United States and elsewhere:

| |
|---|
| 5,819,443 |
| 5,743,032 |
| 5,603,172 |
| 4,669,205 |
| 3,772,803 |
| 2,962,821 |
| 2,116,351 |

SUMMARY OF THE INVENTION

A sectional snowplow of the type having a laterally extending moldboard or scraping bearing wall member, having a plurality of independently mounted sections in side by side relationship which can each rise and fall relative to, and independently of, those sections on either side. The advantage of this invention and improvement over the prior art is that all sections of the laterally extending sectional moldboard remain in continuous scraping contact with the surface below, even though portions of the surface may become elevated relative to laterally adjacent portions as the snowplow is moved forward. Snow can thus be removed from each portion of an airport runway or from each portion of a parking lot by a single pass. Repeated passes of the snowplow over the same surface areas can therefore be avoided.

DETAILED DESCRIPTION OF PREFERRED EMBODIMENT

Figure 1:
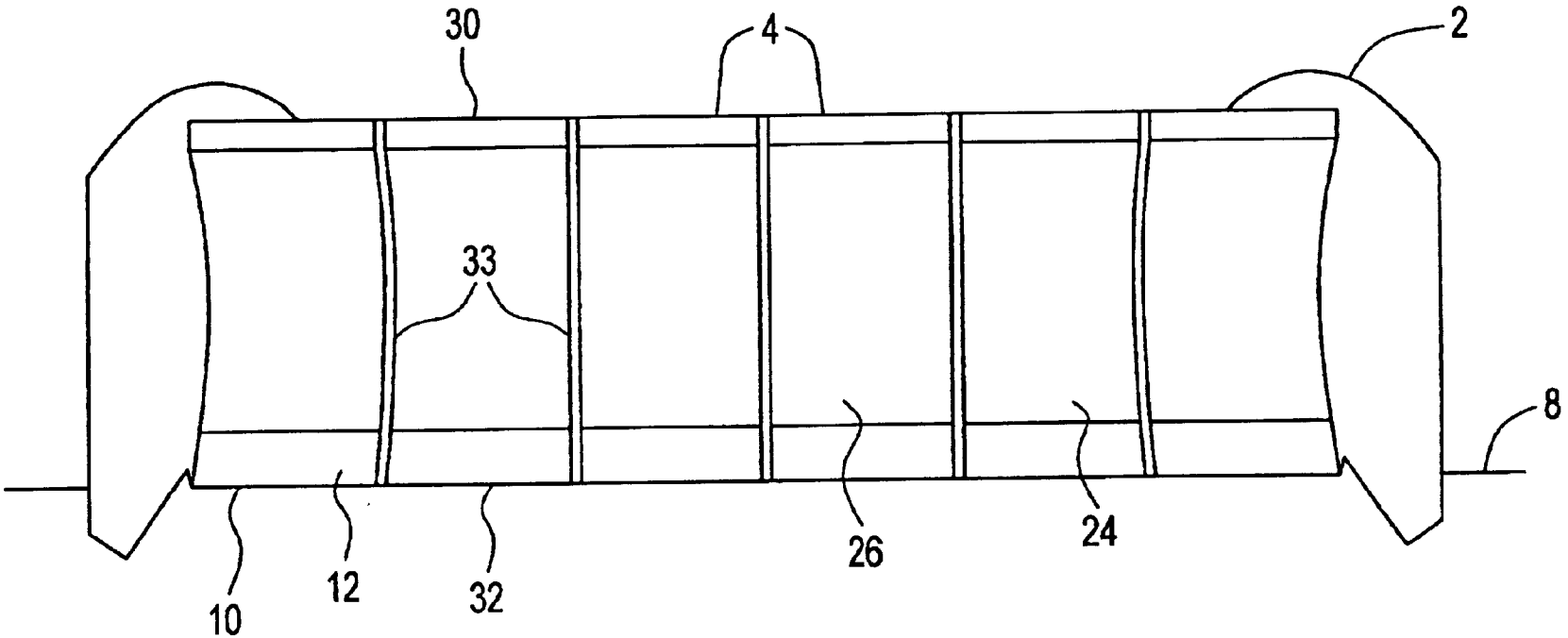
FIG. 1 is an elevation view from the front of a sectional snowplow in accordance with this invention.
Figure 2:
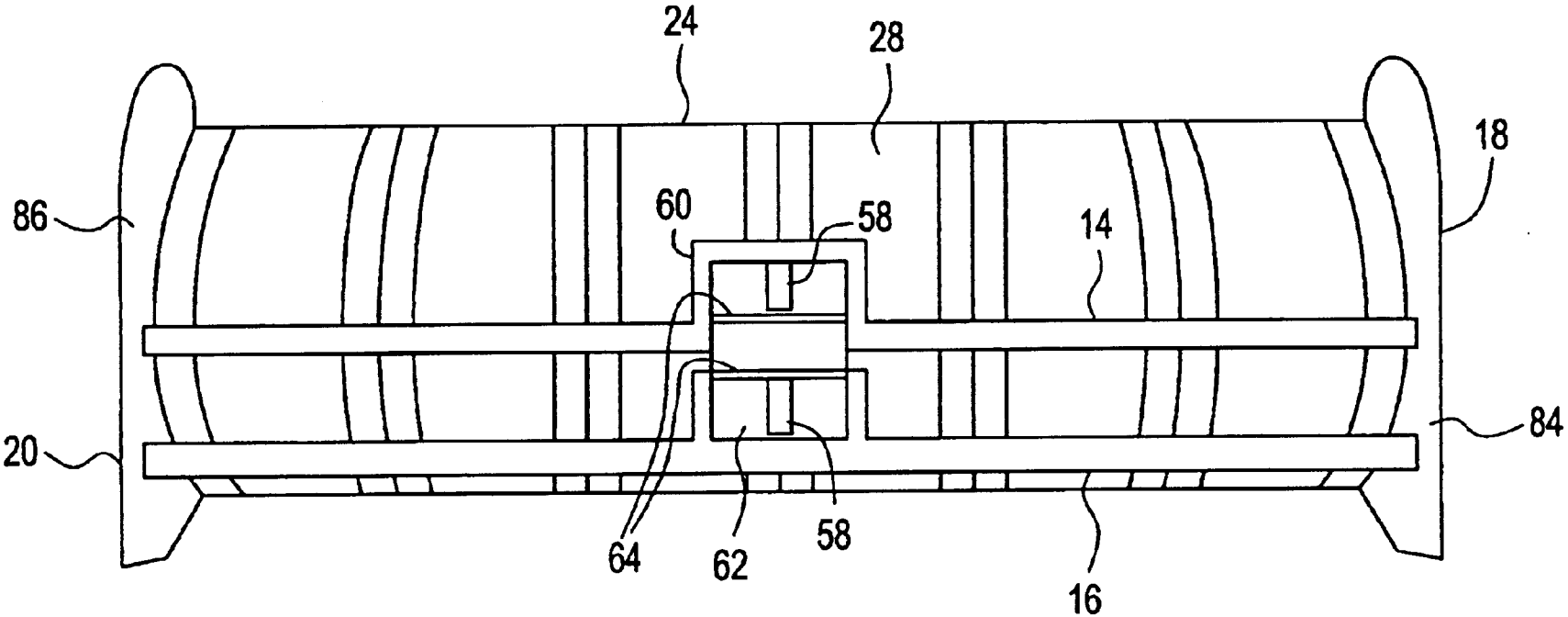
FIG. 2 is an elevation view from the rear of a sectional snowplow in accordance with this invention.
Figure 3:
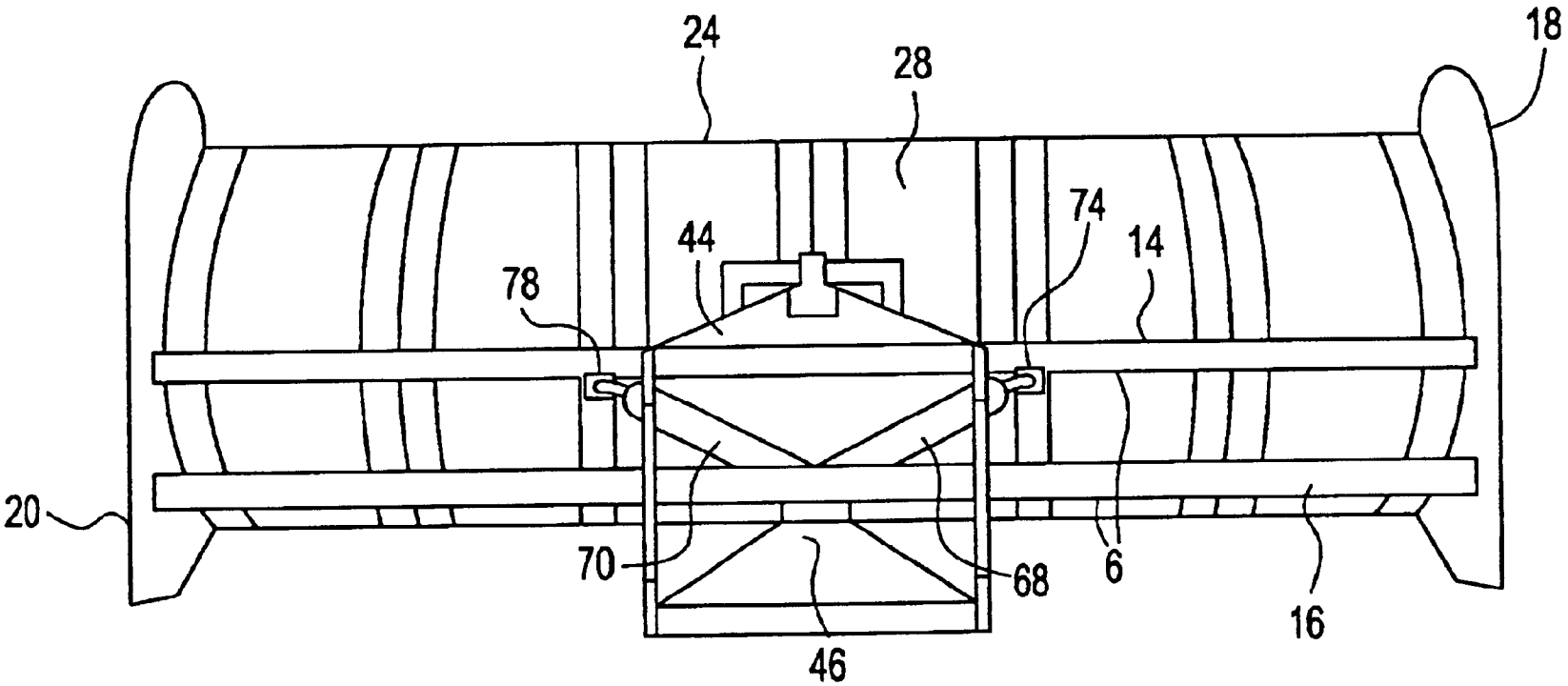
FIG. 3 is an elevation view from the rear of the sectional snowplow in FIG. 2, but with the connecting frame attached which enables connecting the snowplow to a power vehicle for operation, the connecting frame having hydraulic cylinders mounted thereon for pivotal movement of the snowplow toward one side or the other.
Figure 4:
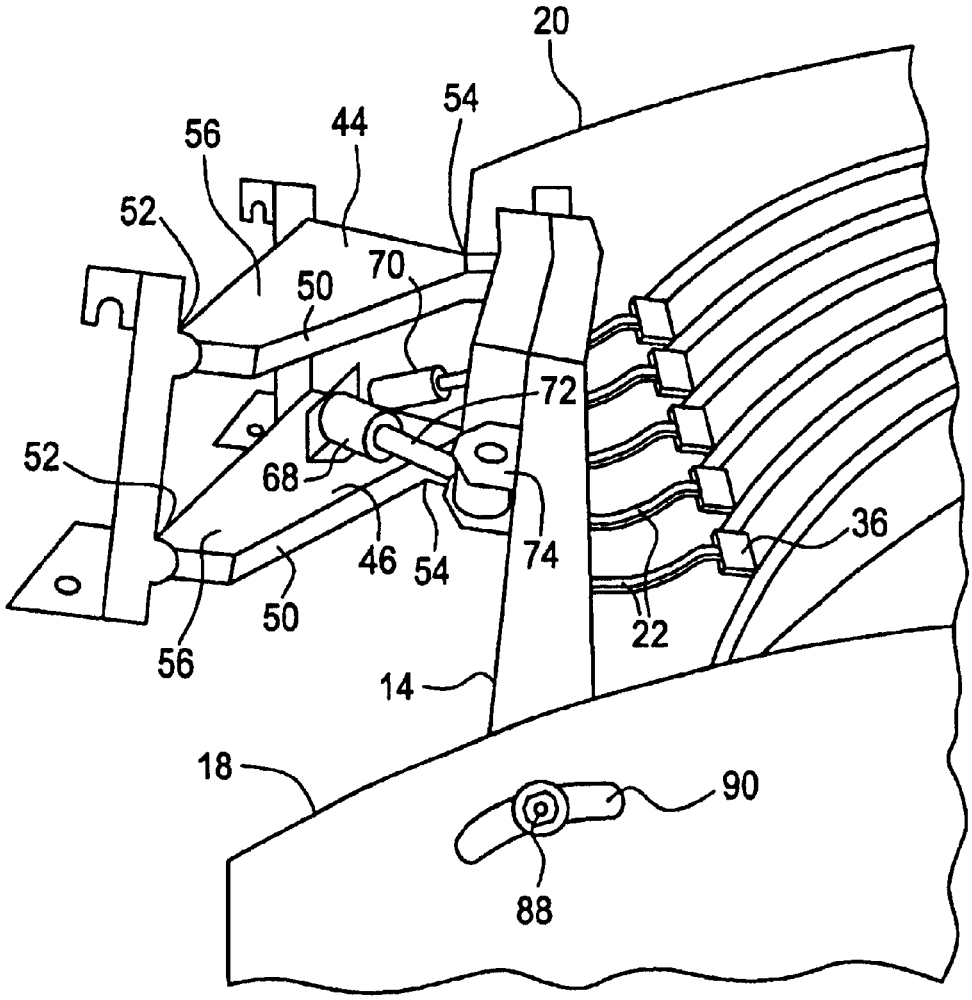
FIG. 4 is a perspective view of a portion of the snowplow in accordance with this invention taken from one side and slightly above to more clearly illustrate how each of the sections are independently mounted on the bars of the frame with flexible connecting members which enables each section to move upwardly and downwardly with the rise and fall of the surface on which each particular section is being pushed forward, separately and independently from the other snowplow sections to either side.
Figure 5:
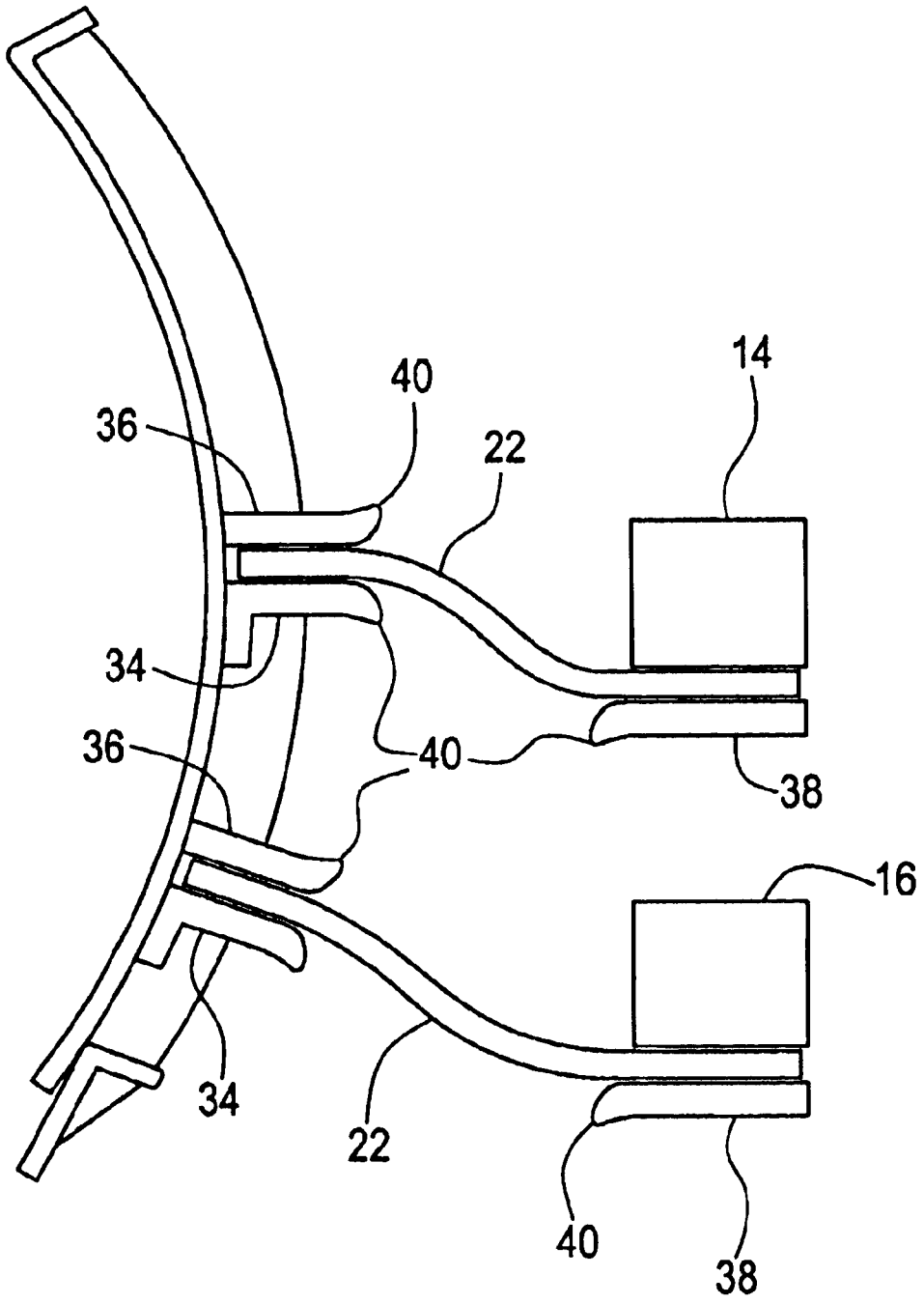
FIG. 5 is a side elevation view of a single snowplow section in accordance with this invention and showing the upper and lower bars of the snowplow frame to which the snowplow section is connected by the flexible connecting members.
Figure 6:
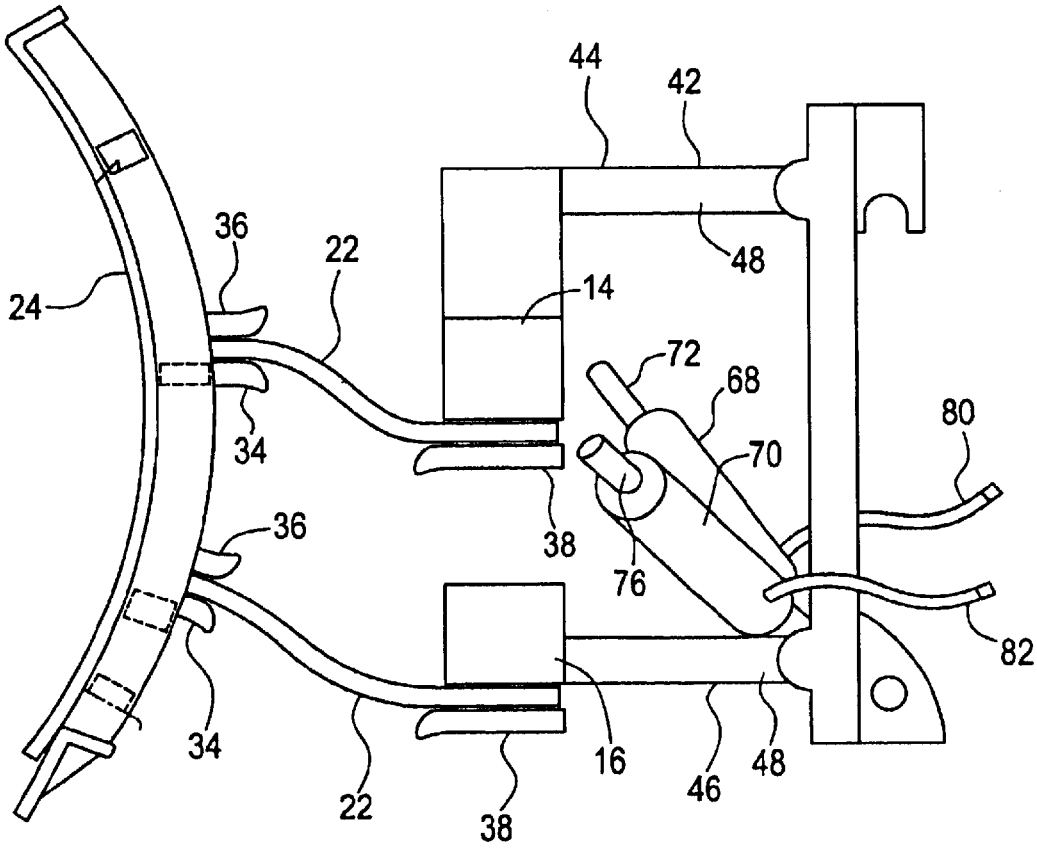
FIG. 6 is a side elevation view of a snowplow section as seen in FIG. 5, but with detail portions of the connecting frame shown connected to the upper and lower bars of the snowplow frame.
Figure 7:
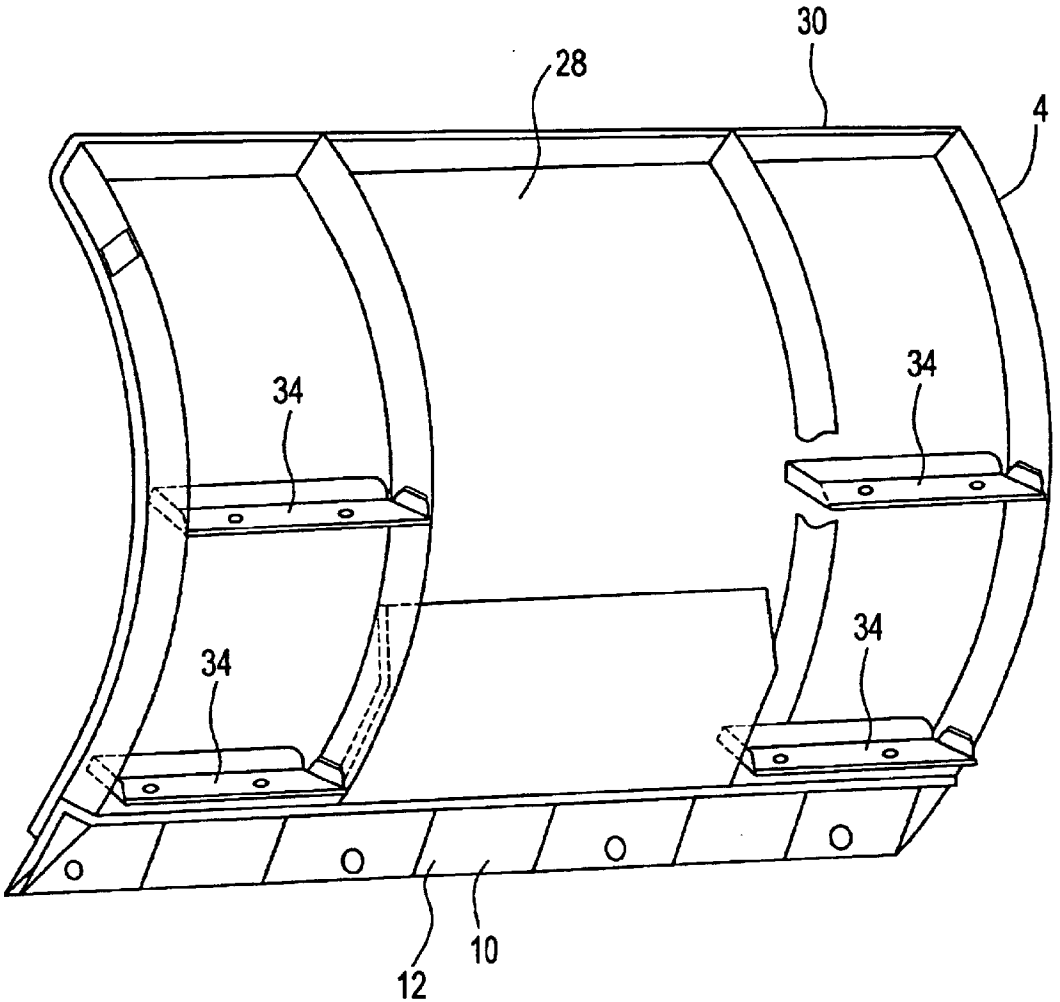
FIG. 7 is an elevation view from the rear of a single snowplow section to illustrate the connecting plates on the back of the moldboard to which the flexible connecting members are secured.
Figure 8:
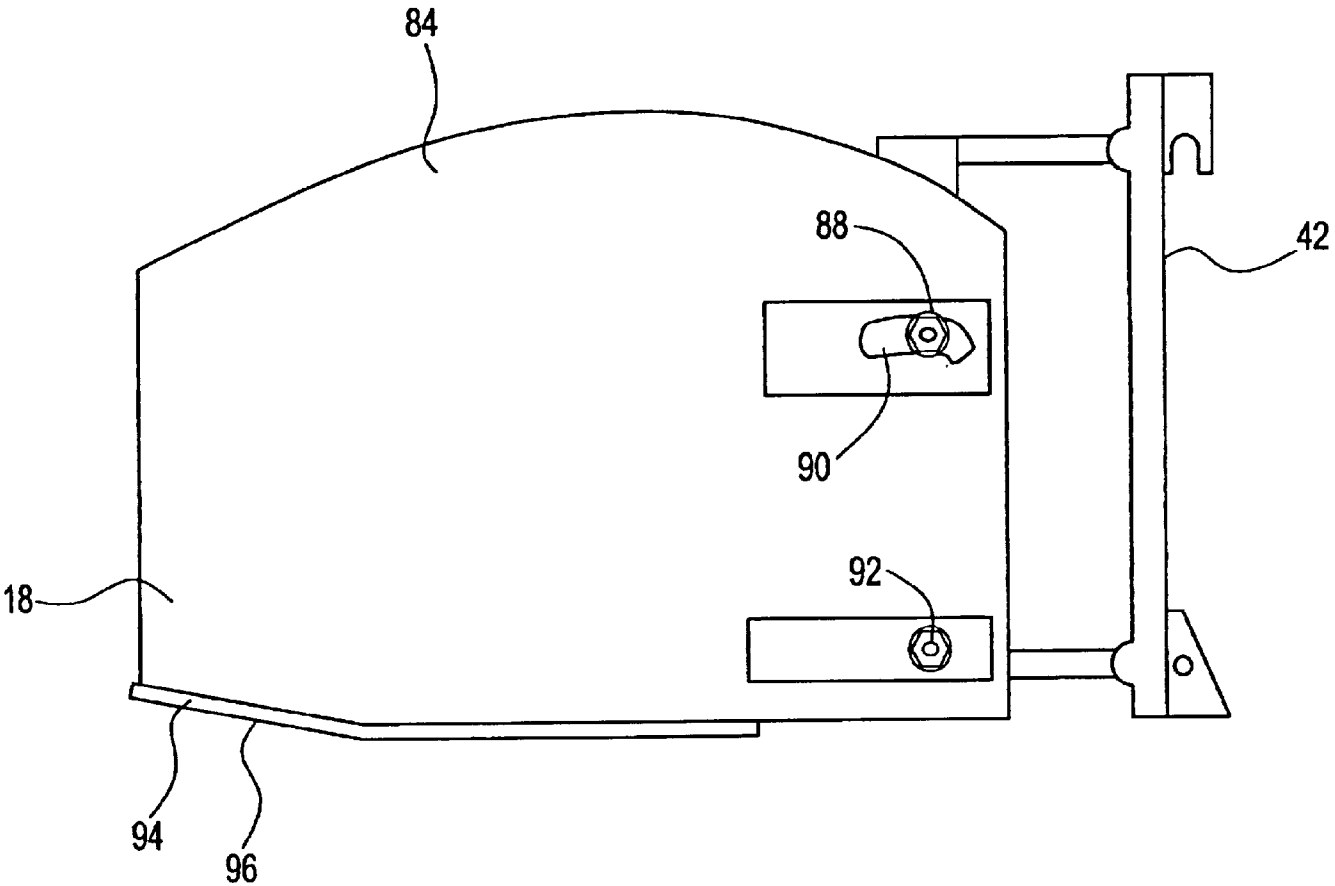
FIG. 8 is a side elevation view of a sectional snowplow in accordance with this invention to illustrate the floating wing or side wall and the construction thereof which enables it to rise and fall with the contour of the terrain on which it is being used.
Figure 9:
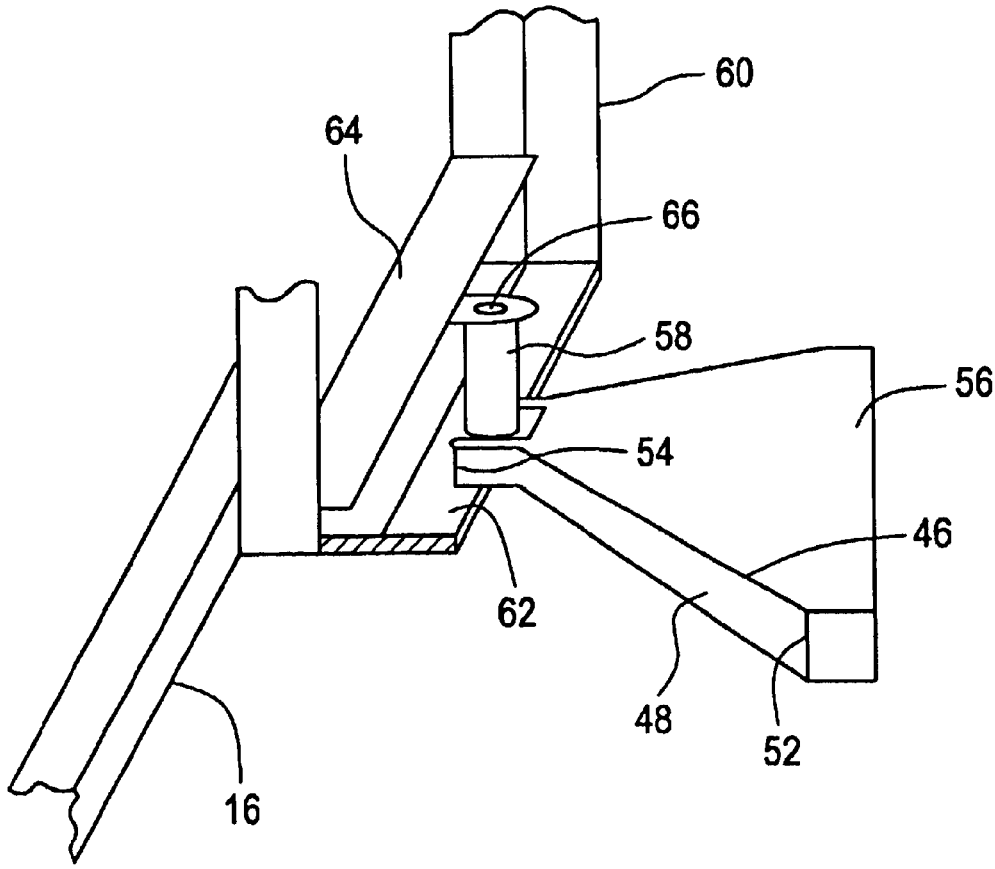
FIG. 9 is a detail cut-away portion of the snowplow frame to illustrate more clearly the structure by which the connecting frame is pivotally secured to the snowplow frame.

A sectional snow plow 2 in accordance with this invention comprises a plurality of independently movable snow plow sections 4 arranged in side by side relationship mounted on a snow plow frame 6 in such a way that each section 4 can independently move upwardly and downwardly with the upward and downward contour of the ground surface 8 with which the bottom edge 10 of the steel scraping blade 12 is in contact as the snow plow 2 is being moved forward.

The snow plow frame 6 includes an upper horizontal bar 14 and a lower horizontal bar 16, both extending laterally across from one side edge 18 of the snow plow to the opposite side edge 20. Each snowplow section 4 is secured to the horizontal bars 14 and 16 by flexible plates 22 of rubber-like material such as a plastic material known as polyurethane 90 A Shore hardness, available from any polyurethane supplier. In a preferred embodiment, each flexible plate 22 is one inch thick, six inches wide, and fifteen and a half inches in length.

Each snowplow section 4 comprises a curved or arcuate moldboard 24 of steel or other comparably hard and rigid material, having a forwardly facing concave surface 26 and a rearwardly facing convex surface 28. Two of the rubber-like flexible plates 22 are secured at their forward ends to the rearwardly facing surface 28 of each snow plow section 4 about midway between the upper edge 30 thereof and the lower edge 32 thereof, and are secured at their rearward ends to the upper horizontal bar 14. Two additional flexible plates 22 are secured at their forward ends to the rearwardly facing surface 28 of each snow plow section 4 near the lower edge 32 thereof, and are secured at their rearward ends to the lower horizontal bar 16. In a preferred embodiment, six snowplow sections 4 each having a width of thirty-two inches, are mounted in side-by-side relationship to provide a sixteen foot wide sectional snowplow 2. One-eighth inch spacers 33 are mounted along one of the side edges of each section 4 in slidable frictional engagement with the side edge of the next adjacent snowplow section 4.

The flexible plates 22 are secured to the rearward facing surface 28 of the moldboard 24 by mounting plates 34 bolted to the moldboard and capture plates 36 which receive the forward end of the flexible plate 22 between the mounting plate 34 and capture plate 36. Bolts extend through the mounting plates 34 and 36 as well as through the flexible plates 22. The forward end of each flexible plate 22 is thus sandwiched and held in place on the back of the moldboard 24 between the mounting plate 34 and the capture plate 36. The rearward end of each flexible plate 22 is secured to its respective horizontal bar 16 or 18 by a capture plate 38 which sandwiches the rearward end between the capture plate 38 and the respective horizontal bar 16 or 18. Each capture plate 36 and 38 include an arcuate or curved outer end 40 to accommodate the curve of the flexible plates 22 when they flex to permit upward or downward movement of the independently movable snow plow sections 4 as the surface with which each is in scraping contact rises or falls.

The sectional snowplow 2 is connected to a drive vehicle by a connecting frame assembly 42. The connecting frame assembly 42 comprises an upper A-shaped frame 44 and a lower A-shaped frame assembly 46. Each A-shaped frame assembly includes a pair of converging side bars, comprising a first side bar 48 and a spaced apart second side bar 50. Each side bar 48 and 50 have rearwardly facing ends 52 and forwardly facing ends 54, and the side bars converge as they extend forwardly from their rearwardly facing ends 52 toward their forwardly facing ends 54. A triangular plate 56 covers the bars 48 and 50. The connecting frame assembly 42 includes a connecting sleeve 58 formed at the forwardly facing ends 54 of the side bars 48 and 50. A corresponding connecting frame structure 60 is provided on the back of the snow plow frame 6 welded or otherwise secured at each side to the lower horizontal bar 16. The connecting frame structure 60 includes a horizontal bottom wall 62 and a horizontal plate 64 spaced apart from, parallel to and above the horizontal bottom wall 62, to receive the connecting sleeve 56 of the connecting frame assembly 42 therebetween and in registration with aligned apertures through the bottom wall 62 and the horizontal plate 64 to receive a connecting pivot pin 66 which thus pivotally connects the connecting frame assembly 42 to the snow plow frame assembly 6.

The connecting frame assembly 42 has a pair of hydraulic cylinders 68 and 70 mounted thereon. The ram 72 of hydraulic cylinder 68 is connected to a connecting bracket 74 secured to the rearward facing surface of the bar 14 at a location to the right of the connecting sleeve 56 and pivot pin 66 of the connecting frame assembly 42 when connected to the snow plow frame assembly 6. The ram 76 of hydraulic cylinder 70 is connected to connecting bracket 78 secured to the rearwardly facing surface of the bar 14 at a location to the left of the connecting sleeve 56 and pivot pin 66 when the connecting frame assembly 42 is connected to the snow plow frame assembly 6. The hydraulic cylinders 68 and 70 are connected for operation to the hydraulic power system of the vehicle which drives the snowplow assembly 2 through the respective hydraulic lines 80 and 82. Thus, when the hydraulic system is operated to move ram 72 forward and ram 76 rearward, the snowplow moldboard 24 is pivoted toward the left on the pivot pin 66. When operated to move the ram 76 forward and the ram 72 rearward, the moldboard 24 is pivoted toward the right on the pivot pin 66.

The sectional snow plow 2 in accordance with this invention includes a first side wall or floating wing member 84 mounted for limited pivotal movement at one side thereof, and a second side wall or wing member 86 mounted for limited pivotal movement at the opposite side thereof. Each wing member 84 and 86 is secured to the snow plow frame assembly 6 by a bolt and washer combination 88, the bolt extending through arcuate slot 90, and threaded into a threaded tap opening to the outer end of the upper horizontal bar 14, plus a bolt and washer combination 92 extending through an aperture in the lower portion of the wing members 84 and 86, such bolt being threaded into a threaded tap opening to the outer end of the lower horizontal bar 16. The arcuate slot 90 permits the wing member 84 and 86, as the case may be, a limited amount of pivotal movement around the bolt 92 at the lower edge of the wing member as the slide member 94 on the bottom edge of the wing member rises and falls with the contour of the surface on which it is sliding as the snow plow is being moved forward by the vehicle on which it is mounted. The slide member 94 includes an upwardly inclined forward portion 96 to initially contact a rise in the surface on which the snow plow is being used, to thereby pivot the wing member upwardly a limited amount and do so automatically to prevent gouging into an upwardly rising ground surface without the need for action or special attention on the part of the operator of the vehicle and snow plow.

I claim:

1. A sectional snowplow having an upper horizontal edge, a lower horizontal edge, and arcuate wall means therebetween for contact with and movement of snow forward as said snowplow is moved forward, said snowplow comprising a plurality of independently, vertically movable snowplow sections arranged in side by side relationship each having an upper horizontal edge, a lower horizontal edge, and arcuate wall means therebetween, said upper horizontal edge of said movable snowplow sections comprising said upper horizontal edge of said snowplow, said lower horizontal edge of said movable snowplow sections comprising said lower horizontal edge of said snowplow, the entire portion of each of said movable snowplow sections from said upper edge thereof to said lower edge thereof including said arcuate wall means of each of said movable snowplow sections being independently movable relative to the other of said movable sections.

2. A sectional snowplow as set forth in claim 1, wherein said plurality of independently movable snowplow sections include a first snowplow section and a second snowplow section, said second snowplow section being mounted in slidable friction engagement with and adjacent to said first snowplow section.

3. A sectional snowplow as set forth in claim 2, including a snowplow frame, wherein said first snowplow section includes a lower portion terminating at said lower horizontal edge in sliding contact with a surface on which said snowplow is being moved, including an inherently flexible connecting member, said first snowplow section is mounted on said snowplow frame by said inherently flexible connecting member for independent movement upwardly and downwardly as said surface on which said lower horizontal edge of said lower portion is in sliding contact rises and falls causing said inherently flexible connecting member to flex to thereby maintain continuous contact with said surface by said lower horizontal edge of said first snowplow section.

4. A sectional snowplow as set forth in claim 2, including first flexible connection means to connect said first snowplow section to said snowplow frame for independent movement upwardly and downwardly of said first snowplow section as said surface on which said first snowplow section is in sliding contact rises and falls, said first flexible connection means flexing to permit said movement upwardly and downwardly of said first snowplow section.

5. A sectional snowplow as set forth in claim 4, wherein said first flexible connection means includes a strip of flexible material.

6. A sectional snowplow as set forth in claim 5, wherein said flexible material is polyurethane.

7. A sectional snowplow as set forth in claim 5, wherein said flexible material is polyurethane 90 A Shore hardness.

8. A sectional snowplow as set forth in claim 5, wherein said strip of flexible material comprises a flexible member about one inch thick, six inches wide and fifteen and a half inches long.

9. A sectional snowplow as set forth in claim 5, wherein said arcuate wall means of said first snowplow section includes an arcuate moldboard extending between said upper and lower horizontal edges thereof, said first flexible connection means includes a plurality of flexible members connected between said moldboard of said first snowplow section and said snowplow frame.

10. A sectional snowplow having an upper horizontal edge, a lower horizontal edge, and arcuate wall means therebetween for contact with and movement of snow forward as said snowplow is moved forward, said snowplow comprising a plurality of independently movable snowplow sections arranged in side by side relationship each having an upper horizontal edge, a lower horizontal edge, and arcuate wall means therebetween, said upper horizontal edge of said movable snowplow sections comprising said upper horizontal edge of said snowplow, said lower horizontal edge of said movable snowplow sections comprising said lower horizontal edge of said snowplow, the entire portion of each of said movable snowplow sections from said upper edge thereof to said lower edge thereof including said arcuate wall means of each of said movable snowplow sections being independently movable relative to the other of said movable sections, including a snowplow frame having an upper laterally extending bar and a lower laterally extending bar, a first side wall connected to said upper and lower bars of said frame on one side thereof, a second side wall connected to said upper and lower bars of said frame on the other side thereof, a first arcuate slot in said first side wall in registration with said upper bar, a first bolt through said first arcuate slot threadedly received in a corresponding threaded recess in said upper bar in registration with said first arcuate slot, a second arcuate slot in said second side wall in registration with said upper bar, a second bolt through said second arcuate slot threadedly received in a corresponding threaded recess in said upper bar in registration with said second arcuate slot.

11. A sectional snow plow as set forth in claim 10, wherein said first side wall includes a bottom edge having a rearward facing end and a forward facing end, said forward facing end of said bottom edge of said first side wall having an upwardly inclined portion, wherein said arcuate wall means of said independently movable snowplow sections include a concave portion facing forward, said concave portions being movable upwardly and downwardly with the other portions of each of said snowplow sections as each is moved independently of others of said independently movable snowplow sections.

12. A sectional snow plow as set forth in claim 11, wherein said second side wall includes a bottom edge having a rearward facing end and a forward facing end, said forward facing end of said bottom edge of said second side wall having an upwardly inclined portion.

* * * * *